US005156427A

United States Patent [19]

Longrie et al.

[11] Patent Number: 5,156,427

[45] Date of Patent: Oct. 20, 1992

[54] PET EXCREMENT SNAP SCOOP

[76] Inventors: Helen M. Longrie, 1526 S. 55th St., Milwaukee, Wis. 53214; George Spector, 233 Broadway Rm 3815, New York, N.Y. 10007

[21] Appl. No.: 737,136

[22] Filed: Jul. 29, 1991

[51] Int. Cl.[5] ..... A01K 29/00; E01H 1/12

[52] U.S. Cl. ..... 294/1.3; 15/257.6; 294/55

[58] Field of Search ..... 294/1.3, 1.4, 9, 10, 294/55; 15/104.8, 257.1, 257.6, 257.7, 257.9

[56] References Cited

U.S. PATENT DOCUMENTS

| | | | |
|---|---|---|---|
| 210,849 | 12/1878 | Goss | 15/257.6 |
| 586,358 | 7/1897 | Hannigan | 15/257.6 |
| 1,903,277 | 4/1933 | Barnes | 294/55 X |
| 2,219,216 | 10/1940 | Anderson | 15/257.6 |
| 3,703,158 | 11/1972 | Lemler | 294/1.3 |
| 3,986,744 | 10/1976 | Krogstad et al. | 294/1.3 |

FOREIGN PATENT DOCUMENTS

| | | | |
|---|---|---|---|
| 3404037 | 8/1985 | Fed. Rep. of Germany | 294/1.3 |
| 102501 | 2/1924 | Switzerland | 294/55 |
| 2172496 | 9/1986 | United Kingdom | 294/1.3 |
| 2227645 | 8/1990 | United Kingdom | 294/1.3 |
| 8303436 | 10/1983 | World Int. Prop. O. | 294/1.3 |

*Primary Examiner*—Johnny D. Cherry

[57] ABSTRACT

A scoop device is provided for removing animal droppings which consists of a shovel member to pick up the animal droppings, a cover member to close over the shovel member and a mechanism for pivoting the cover member to the shovel member. When the cover member is placed in an open position, the shovel member can pick up the animal droppings. When the cover member is placed in a closed position, it will prevent the animal droppings from accidentally departing the shovel member.

2 Claims, 1 Drawing Sheet

PET EXCREMENT SNAP SCOOP

BACKGROUND OF THE INVENTION

The instant invention relates generally to animal excrement collecting devices and more specifically it relates to a scoop device for removing animal droppings, which provides a mechanism for retaining the droppings therein.

There are available various conventional animal excrement collecting devices which do not provide the novel improvements of the invention herein disclosed.

SUMMARY OF THE INVENTION

A primary object of the present invention is to provide a scoop device for removing animal droppings that will overcome the shortcomings of the prior art devices.

Another object is to provide a scoop device for removing animal droppings that includes a shovel portion to pick up the animal droppings and a cover portion to retain the animal droppings within the shovel portion to prevent the accidental departure of the animal droppings therefrom.

An additional object is to provide a scoop device for removing animal droppings that includes a mechanism built into the device for reciprocating the cover portion back and forth to better scrape up the animal droppings into the shovel portion.

A further object is to provide a scoop device for removing animal droppings that is simple and easy to use.

A still further object is to provide a scoop device for removing animal droppings that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 2:
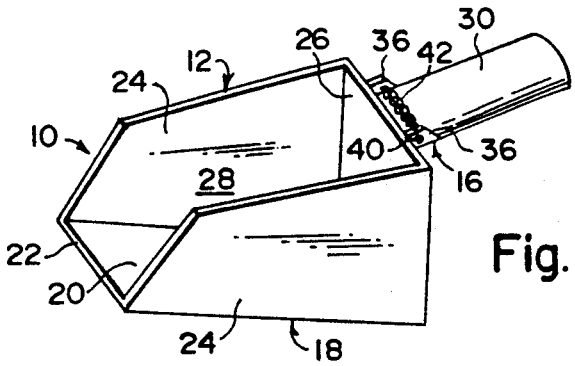
FIG. 2 is a perspective view of the shovel portion thereof.

Turning now descriptively to the drawings, in which similar reference characters denote similar elements throughout the several views, the Figures illustrate a scoop device 10 for removing animal droppings which consists of a shovel member 12 to pick up the animal droppings, a cover member 14 to close over the shovel member 12 and a mechanism 16 for pivoting the cover member 14 to the shovel member 12. When the cover member 14 is placed in an open position, the shovel member 12 can pick up the animal droppings. When the cover member 14 is placed in a closed position, it will prevent the animal droppings from accidentally departing the shovel member 12.

The shovel member 12 includes a trowel 18 having a bottom wall 20 with a beveled front edge 22, a pair of side walls 24 and a back wall 26 to form a chamber 28 to receive the animal droppings therein. A short handle 30 extends rearwardly from the top of the back wall 26 of the trowel 18, so that the short handle 30 can be gripped by a hand of a person using the scoop device 10.

The cover member 14 includes an L-shaped closure plate 32 sized to fit over the top and front of the trowel 18. A thumb lever 34 extends upwardly from the back of the L-shaped closure plate 32 proximate the short handle 30 of the shovel member 12 to be manually depressed by a thumb on the hand of the person gripping the short handle 30.

Figure 3:
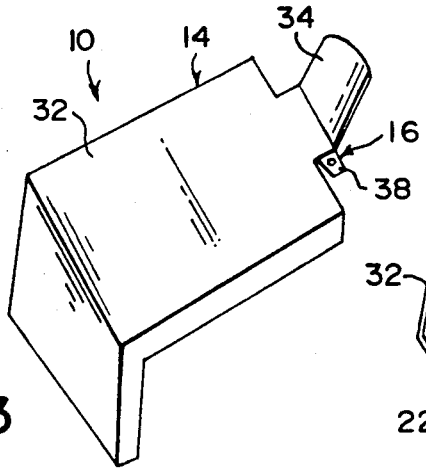
FIG. 3 is a perspective view of the cover portion thereof.
Figure 1:
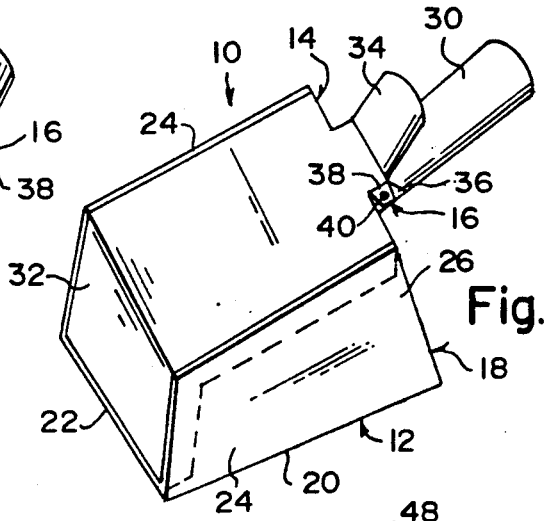
FIG. 1 is a perspective view of the instant invention.

The pivoting mechanism 16, as shown in FIGS. 1 to 3, includes a first set of spaced apart ears 36 extending upwardly from the short handle 30 at the rear wall 26 of the trowel 18. A second set of spaced apart ears 38 extend downwardly from the thumb lever 34 of the L-shaped closure plate 32. An axle pin 40 extends through the first ears 36 and the second ears 38. A biasing spring 42 is on the axle pin 40 to normally bias the L-shaped closure plate 32 closed over the trowel 18.

Figure 4:
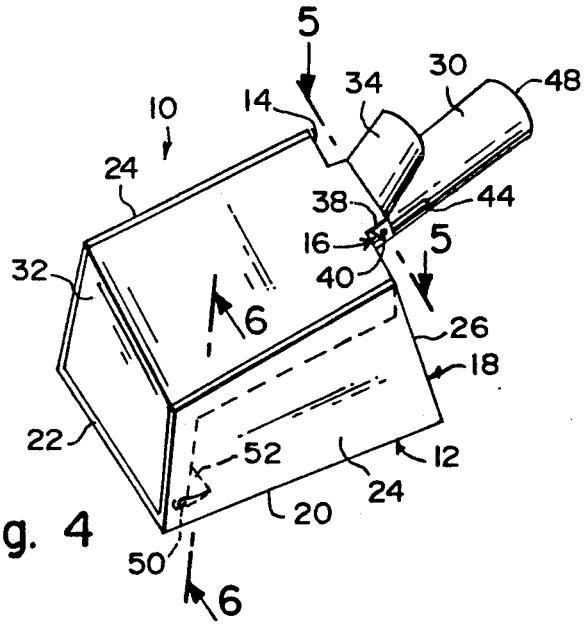
FIG. 4 is a perspective view of a modification.
Figure 5:
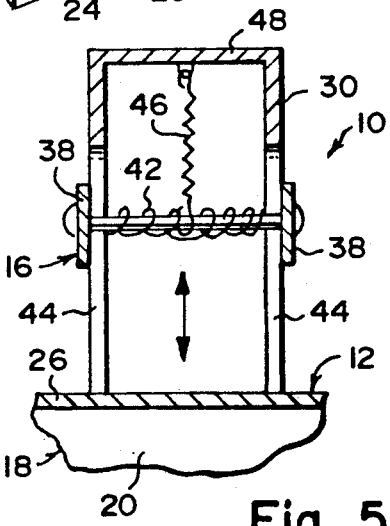
FIG. 5 is an enlarged horizontal cross sectional view taken along line 5—5 in FIG. 4, showing the slide track therein to move the cover portion back and forth.

The pivoting mechanism 16, as shown in FIGS. 4 and 5, include a set of spaced apart ears 38 extending downwardly from the thumb lever 34 of the L-shaped closure plate 32. The short handle 30 has a pair of spaced apart longitudinal slots 44 therein. An axle pin 40 extends through the ears 38 and the slots 44. A biasing spring 42 is on the axle pin 40 to normally biases the L-shaped closure plate 32 closed over the trowel 18.

Figure 6:
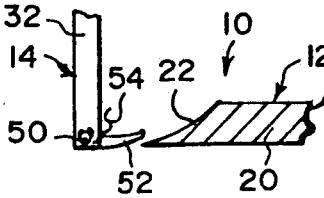
FIG. 6 is an enlarged vertical cross sectional view taken along line 6—6 in FIG. 4, showing the pivotable blade on the cover portion and the bevel edge on the shovel portion in greater detail.

A compression spring 46 extends between the back 48 of the short handle 30 and the center of the axle pin 40., so that the L-shaped closure plate 32 can reciprocate back and forth with respect to the trowel 18. A pivot pin 50, as best seen in FIG. 6, is on the front edge of the L-shaped closure plate 32, while a blade 52 is carried on the pivot pin 50. A biasing spring 54 is on the pivot pin 50 to normally keep the blade 52 facing towards the beveled front edge 22 of the bottom wall 20 of the trowel 18. When the L-shaped closure plate 32 is reciprocated back and forth, the blade 52 will help push the animal droppings into the trowel 18.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A scoop device for removing animal droppings which comprises:

a) a shovel member to pick up the animal droppings;

b) a cover member to close over said shovel member;

c) means for pivoting said cover member to said shovel member so that when said cover member is placed in an open position, said shovel member can pick up the animal droppings and when said cover member is placed in a closed position, it will prevent the animal droppings from accidentally departing said shovel member; wherein said shovel member includes:

d) a trowel having a bottom wall with a beveled front edge, a pair of side walls and a rear wall to form a chamber to receive the animal droppings therein;

e) a short handle extending rearwardly from the top of the back wall of said trowel, so that said short handle can be gripped by a hand of a person using said scoop device; wherein said cover member includes:

f) an L-shaped closure plate sized to fit over the top and front of said trowel; and g) a thumb lever extending upwardly from the back of said L-shaped closure plate proximate said short handle of said shovel member, to be manually depressed by a thumb on the hand of the person gripping said short handle; wherein said pivoting means includes:

h) a set of spaced apart ears extending downwardly from said thumb lever of said L-shaped closure plate;

i) said short handle having a pair of spaced apart longitudinal slots therein;

j) an axle pin extending through said ears and said slots; and k) a biasing spring on said axle pin to normally bias said L-shaped closure plate closed over said trowel.

2. A scoop device as recited in claim 1, further including a) a compression spring extending between the back of said short handle and the center of said axle pin, so that said L-shaped closure plate can reciprocate back and forth with respect to said trowel;

b) a pivot pin on the front edge of said L-shaped closure plate;

c) a blade carried on said pivot pin; and d) a biasing spring on said pivot pin to normally bias said blade facing towards the beveled front edge of the bottom wall of said trowel, so that when said L-shaped closure plate is reciprocated back and forth, said blade will help push the animal droppings into said trowel.

* * * * *